US009580086B2

(12) United States Patent
Low et al.

(10) Patent No.: US 9,580,086 B2
(45) Date of Patent: Feb. 28, 2017

(54) RAILCAR COVER SYSTEMS

(71) Applicants: Trevor Low, North Vancouver (CA); Mark Doldon, North Vancouver (CA); John Cruikshank, Brisbane (AU); Marvin Hlynka, Richmond (CA)

(72) Inventors: Trevor Low, North Vancouver (CA); Mark Doldon, North Vancouver (CA); John Cruikshank, Brisbane (AU); Marvin Hlynka, Richmond (CA)

( * ) Notice: Subject to any disclaimer, the term of this patent is extended or adjusted under 35 U.S.C. 154(b) by 0 days.

(21) Appl. No.: 14/714,753

(22) Filed: May 18, 2015

(65) Prior Publication Data

US 2016/0046304 A1 Feb. 18, 2016

Related U.S. Application Data

(63) Continuation of application No. 13/517,426, filed on Jan. 7, 2013, now abandoned.

(51) Int. Cl.

| | |
|---|---|
| ***B61D 39/00*** | (2006.01) |
| ***B61D 17/12*** | (2006.01) |
| ***B61D 49/00*** | (2006.01) |

(52) U.S. Cl.

CPC ..... *B61D 39/001* (2013.01); *B61D 17/12* (2013.01); *B61D 39/002* (2013.01); *B61D 39/007* (2013.01); *B61D 49/00* (2013.01)

(58) Field of Classification Search

CPC ..... B61D 39/001; B61D 39/007
USPC ..... 105/377.01, 377.04, 377.05, 377.06
See application file for complete search history.

(56) References Cited

U.S. PATENT DOCUMENTS

| | | | | |
|---|---|---|---|---|
| 4,613,174 A * | 9/1986 | Berg | B61D 9/12 105/377.05 |
| 4,929,816 A * | 5/1990 | Theurer | E01B 29/46 219/100 |
| 2008/0236439 A1* | 10/2008 | Low | B61D 17/12 105/377.05 |

* cited by examiner

*Primary Examiner* — Zachary Kuhfuss
(74) *Attorney, Agent, or Firm* — Stephen R. Burri

(57) ABSTRACT

A cover assembly for an open top railcar, the assembly having semi-rigid cover reversibly movable between a closed position atop the railcar and an open position alongside the railcar or separate from it. The cover may be connected to the railcar with hinge-latches or linkage arms which permit the cover to be held flat alongside the railcar in an open position, or removed from the railcar during loading and unloading. A load grooming device shapes the load of a loaded railcar to a selected contour. Opening and closing of covers may be continuous and automated, using curved tracks, cranes or mechanical arms to engage and open covers, and conveying devices or vehicles to handle covers during loading and unloading of railcars.

13 Claims, 8 Drawing Sheets

RAILCAR COVER SYSTEMS

CROSS-REFERENCE TO RELATED APPLICATIONS

This application is a continuation-in-part of U.S. non-provisional patent application Ser. No. 12/038,348 filed Feb. 27, 2008, and claims priority from U.S. provisional patent application No. 61/288,786 filed Dec. 21, 2009.

FIELD OF THE INVENTION

The present invention relates to rail car cover systems. In particular, the present invention relates to cover systems for open top rail cars.

BACKGROUND OF THE INVENTION

It is known to provide open top railway cars, whether bottom dump hoppers or top unloading gondolas, which may be fitted with removable covers to enclose the top openings. These covers typically may be lifted free of the cars for loading, or, in the case of gondolas, for unloading. Once a load has been loaded or unloaded, the cover may be replaced.

Such covers provide a number of benefits, including product containment, for example, prevention of ingress of dust, which represents an environmental hazard, and prevention of product loss. Other benefits include product protection, for example, protection from rain or snow and protection from debris. Many different granular or powder products may be shipped in this way, including minerals, grains, hazardous waste, coal, and other products.

Typically, such covers are fastened onto railcars with various types of clamps or brackets which fix the cover to the car and prevent it from coming loose in transit, but which allow manual or automatic opening in order to handle the cover.

Covers typically may be manufactured of steel, aluminum, or various composite materials, each of which has its advantages and disadvantages. Covers may be built as a single piece covering the full length and width of the railcar, or as two or more pieces, depending on the material selected and the circumstances of operation. Due to their large size and manner of removal, prior art rail car covers require fixed or mobile heavy equipment for removal and replacement, as well as large areas for moving and stacking removed covers.

The weight of each cover can be significant, ranging from 1500 lbs for a composite cover to as much as 5000 lbs for a steel cover. The cover weight reduces the effective payload of the rail car, thereby reducing the cargo load the user can haul.

In high volume situations, it is often not possible to arrange a suitable method for removal and replacement of covers. For instance, in a coal loading facility, the rail cars typically do not stop moving, but are driven slowly in one long string through the facility under loading chutes and exit the far side of the loading facility which may be several hundred feet away. Slowing or stopping of trains is generally not an option. The logistics of lifting covers off at the entrance to the facility, moving them around the facility to the loadout area at the loading facility exit, and replacing the covers on the railcars, make use of covers very problematic. As a result, to date, no large scale loading operations of this type have been converted to covered cars.

On the unloading end, the problem is similar. For unloading gondola type railcars, high volume operations such as coal will use a railcar dumper, a large device which rotates about the axis of the railcar couplers, completely inverting one or more railcars at a time, while they remain coupled to the cars ahead and behind.

Past and current solutions have included lifting of covers within the dumper building over the dumper itself. This adds time to the dump cycle, and is not suitable for retrofit situations, as dumper buildings typically do not have the space capacity for such a cover lifting mechanism, and many dumpers are constructed with part of their mechanism over top of the car, which would prevent removal of the rail car cover. This solution also would not work at the loading end. Accordingly, a new cover removal system is needed.

Any bulk material cover system may not function if the load is too high or spills onto sills or tail areas of the rail car. Problems in loading are common. A device is needed to groom the shape profile of a rail car load on a continuously moving string or rail cars.

In the drawings, selected embodiments of the invention are illustrated by way of example. It is to be expressly understood that the description and drawings are only for the purpose of illustration and as an aid to understanding, and are not intended as a definition of the limits of the invention.

SUMMARY OF THE INVENTION

There is provided a cover assembly for a railcar of the type having a top opening and first and second sides, the cover assembly comprising a semi-rigid cover having opposed first and second side edges; first and second linkage means, first linkage means connecting first side edge to first side, and second linkage means connecting second side edge to second side; wherein cover is reversibly movable between a closed position atop the railcar and an open position alongside either the first or the second side of the railcar.

The linkage means may comprise one or more pairs of arm linkages, each arm linkage pivotally connected at a first end to the cover and at a second end to the railcar. The linkage means may comprise one or more pairs of hinge-latches, a first hinge-latch of each pair reversibly connecting the first side edge of the cover to the corresponding side of the railcar, and a second hinge-latch of each pair connecting the second side edge of the cover to the corresponding side of the railcar. Each hinge-latch may comprise a car sub-component mounted on the railcar, and a cover sub-component mounted on the cover.

The car sub-component of the hinge-latch may include at least one hinge rod receptacle having a selectively shaped receiving plate and a groove for receiving a hinge rod, and the corresponding cover sub-component of the hinge-latch may comprise a plate attached to the external surface of the cover, opposing parallel brackets extending perpendicularly from opposing edges of the plate, and a hinge rod extending between the parallel brackets, wherein the hinge rod is reversibly and pivotally engageable with the groove of the receiving plate.

In another of its aspects, there is provided a hinge-latch for a cover for an open top railcar, wherein the hinge-latch may comprise a car sub-component mounted on the railcar, and a cover sub-component mounted on the cover, wherein the car sub-component of the hinge-latch includes at least one hinge rod receptacle having a selectively shaped receiving plate and a groove for receiving a hinge rod, and the corresponding cover sub-component of the hinge-latch may comprise a plate attached to the external surface of the cover, opposing parallel brackets extending perpendicularly from opposing edges of the plate, and a hinge rod extending between the parallel brackets, wherein the hinge rod may be reversibly and pivotally engageable with the groove of the receiving plate. The groove of the receiving plate may be selectively shaped to permit entry and egress of the hinge rod of the cover sub-component in only a selected range of directions.

The cover assembly may further comprise a first end closure door at a first longitudinal end of the cover and a second end closure door at an opposing second longitudinal end of the cover, each end closure door pivotable about a lower straight edge and about an apex. Each end closure door may be convertible between a position co-planar to the cover when the cover is in an open position and a non-planar raised position when the cover is in a closed position.

The cover system may comprise a flexible cover and connection means for connecting the cover to an open top railcar, wherein the cover may be reversibly convertible between an planar configuration in a relaxed open position alongside the railcar, and a convex configuration in a closed position under tension atop the railcar. The connection means may comprise a plurality of pairs of the hinge-latches. The force of the tension of the closed position may be used to maintain the bar of the car sub-component within the notch of the cover sub-component.

In one of the aspects of the invention, there is provided a cover system for open top railcars comprising cover means for reversibly covering the open top of the railcar; cover attachment means for reversibly attaching the cover means to an open top rail car; cover lifting means for moving cover means from a closed position to an open position; cover engagement means for releasably connecting cover lifting means to cover means; and support means for positioning and guiding the cover lifting means.

The cover system may further comprise cover transport means for moving cover means from a railcar unloading location to a railcar loading location. The cover means may be a unitary cover convertible between a convex closed position atop the railcar and a flat open position. The cover means may comprise a plurality of covers, each cover covering a portion of the opening of the railcar.

The cover attachment means may comprise a plurality of hinge-latches, or a plurality of arm linkages, each arm linkage pivotally connected at a first end to the cover and at a second end to the railcar.

The cover system further may comprise receiving means, wherein the cover lifting means may have a stationary opening mechanism at a railcar loading facility, the opening mechanism having engaging means for engaging the receiving means of the cover system and lifting the cover as the railcar moves past the opening mechanism. The cover system further may comprise receiving means, wherein the cover lifting means may have one or more arms for engaging the receiving means of the cover system and lifting the cover. The arms may be multiple joint arms.

The cover system further may comprise receiving means, wherein the cover lifting means have a crane apparatus for engaging the receiving means of the cover system and lifting the cover. The cover lifting means may be a fixed helical guide which engages the cover and lifts the cover as the railcar moves past the guide. The support means may be an overhead structural frame.

Alternatively, the support means may be a ground based curved track above and around a string of railcars.

According to another of its aspects, the invention provides a method for reversibly opening a cover from each of the railcars of a string of open top railcars, comprising the steps of: a. moving the string of railcars along a track until the first railcar is in a cover opening position; b. opening the cover; c. moving the string of railcars further along the track until the next railcar is in the cover opening position; d. repeating steps b and c until all covers have been opened; and e. closing each open cover as it reaches a cover closing position along the track.

The method may further comprises temporarily removing the cover from the railcar after opening the cover, and transporting the removed cover from the cover opening position to the cover closing position. The removed cover may be transported by a mechanical conveyance device such as a conveyor belt, or by a vehicle.

In another of its aspects, the invention provides a load grooming device for shaping the top side of a load in an open top railcar, the load grooming device comprising a selectively contoured member reversibly positionable above a loaded railcar, whereby relative movement of the railcar past the contoured member shapes the load according to the selected contour. The load grooming device may comprise sensor means for detecting the height of a railcar load.

BRIEF DESCRIPTION OF THE DRAWINGS

A detailed description of the preferred embodiment is provided below by way of example only and with reference to the following drawings in which.

DETAILED DESCRIPTION OF THE INVENTION

Figure 1:
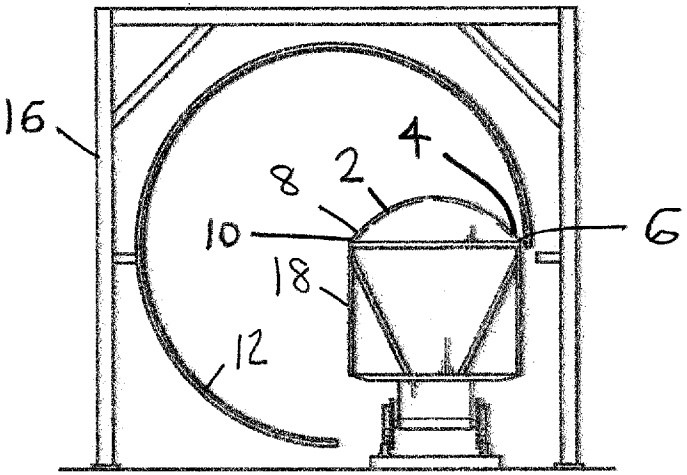
FIG. 1 is an end plan view of a railcar within a helical track structure having a pair of helical tracks.

The present invention comprises a system for removal and replacement of top-loading open top rail car covers. According to one embodiment of the present invention, there is provided a semi-automatic or fully automatic system for continuous serial handling of rigid or self supporting rail car covers for gondola rail cars. Preferably, a continuous method is used to ensure use of covered rail cars does not interfere with methods of car loading or unloading for continuously moving trains.

According to another embodiment of the present invention, similar technology may also be used for situations in which train motion is intermittent at loading or unloading locations, but is part of a continuous industrial process. Use of an intermittent method ensures that use of covered cars does not interfere with methods of car loading or unloading for intermittently moving trains.

According to an embodiment of the system of the present invention, there is provided cover means for an open top rail car, cover attachment means for reversibly attaching a cover to an open top rail car, cover lifting means for moving a cover from a closed position to an open position, cover engagement means for releasably connecting cover lifting means to a cover, support means for positioning and guiding the cover lifting means, and cover transport means for moving a cover from a rail car unloading location to a rail car loading location. Coordinated operation of the system of the present invention will be achieved with various configurations of computers, sensors, controls, motors and actuators.

The cover means may be a cover 2 comprising a single unit per rail car, or it may comprise a plurality of covers on each car. Preferably, the rail car covers are sufficiently self supporting when in a closed position attached to the top of a rail car as to hold an intended three-dimensional shape. Preferably, each cover is sufficiently flexible across its width as to be able to lie flat against the gondola car when in an open position. In one embodiment, a semi-rigid cover may consist of a cover body that, when unstressed, would lay flat, with or without pivoting or flexible end door closures.

Each cover is attachable to the top of a rail car over the rail car opening. Each cover 2 may be unlatched along one edge 4 on a first side 6 of the cover and rotated about a second edge 8 on an opposing second side 10 of the cover from a closed position atop the rail car to an open position alongside the rail car, wherein the string of rail cars is moving on a continuous basis.

Figure 2:
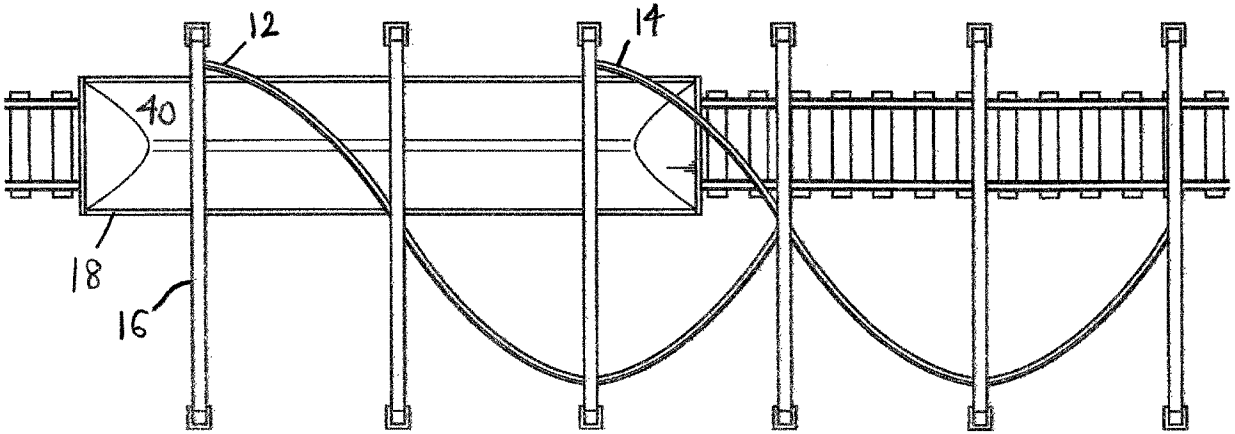
FIG. 2 is a top plan view of a railcar within a helical track structure having a pair of helical tracks.
Figure 3:
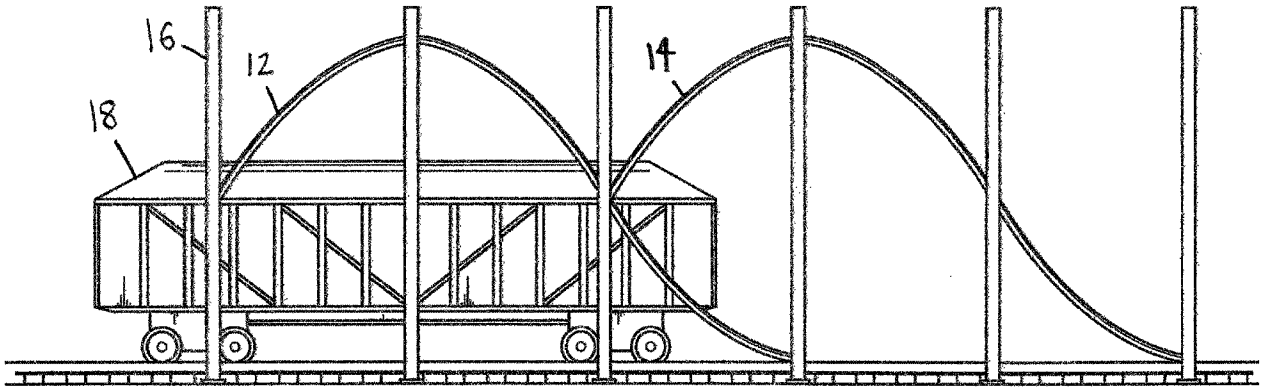
FIG. 3 is a side plan view of a railcar within a helical track structure having a pair of helical tracks.

As depicted in FIGS. 1, 2 and 3, a pair of helical tracks 12, 14 may be used to engage a railcar cover 2 and rotate it 270 degrees along one edge to an open position alongside the railcar. FIG. 1 is an end view of the helix structure 16 and a railcar 18 with the cover in a closed position. FIG. 2 is a top view of the helix structure with a railcar cover in the closed position. FIG. 3 is a side view of the helix structure with a railcar cover in the closed position.

Figure 4:
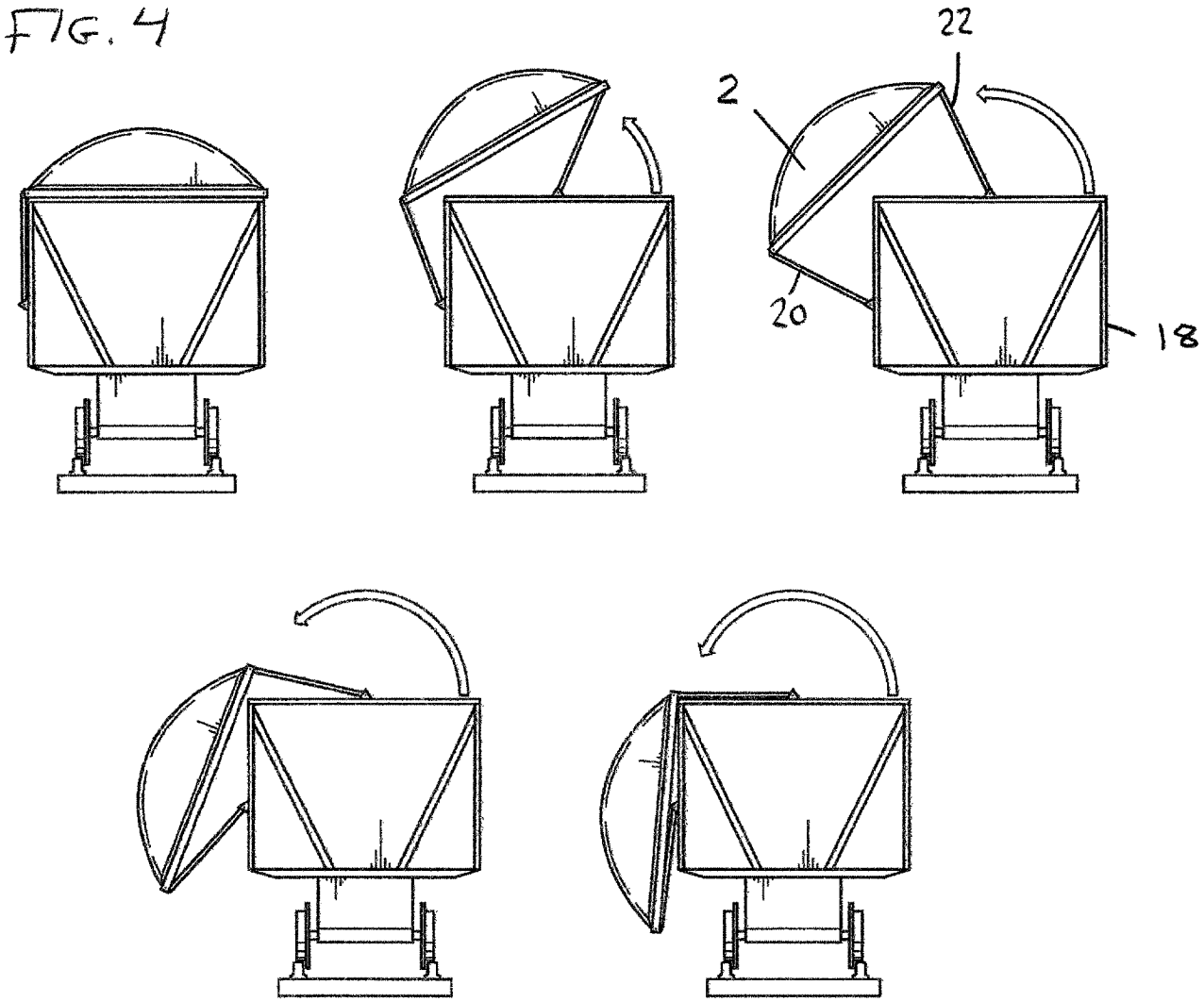
FIG. 4 is a series of end views of a covered railcar showing the sequence of removal of the railcar cover according to one embodiment of the invention.

According to one embodiment of the present invention depicted in FIG. 4, the cover attachment means may be one or more arm linkages 20, 22. These linkages may be attached to and pivotable both on the car 18 and on the cover 2 to enable the cover to hang to the side of the car when in an open position.

According to another embodiment, the cover attachment means may be pivotable links. As the cover is rotated from a closed position atop the rail car into an open position alongside the rail car, the cover hangs alongside the rail car, suspended by the pivotable links.

According to another embodiment of the present invention, the cover attachment means may be a hinge-latch system. The preferred arrangement of hinge-latches is a plurality of hinge-latches along each side of the rail car. Preferably, each cover may be opened by rotation about either of the opposed longitudinal sides. A rail car may enter a facility either with a first end forward, or an opposing second end forward, requiring the capacity to open the cover to both sides. Ideally, the cover attachment means may serve as both a latch and a hinge.

The hinge-latch 24 of the present invention comprises two major components. A car component is mounted on the rail car, and a cover component is attached to the cover. The car component has a receiver in the form of a groove 30 to receive a bar 32 of the cover component. The cover component further comprises a latch element 34 comprising a flange 36 and a looped bar 32 for engaging the receiver. The latch element snaps into the receiver. The cover component is rotatable about the axis of the bar.

In a closed position each hinge-latch anchors a semi-rigid cover to the rail car to maintain the cover shape necessary for the cover to be self-supporting. Covers are sufficiently flexible across their width to lay flat against a gondola car when in an open position, but when in a closed position on top of a car, the covers of the present invention have an outward spring effect, presenting a convex surface on the top of the rail car. In one embodiment of the present invention, this spring action is used to operate the latch mechanism, thereby reducing the need for moving parts and simplifying the hardware. As the cover is rotated from a closed position to an open position, the bar of the cover component is released from the receiver of the car component. Conversely, as the cover is rotated into a closed position, the bar of the cover component is engaged by the receiver of the car component. The tension of the spring effect resulting from the resilience of the semi-rigid cover holds the bar in the latch mechanism.

Each hinge-latch must hold a cover against all loads and imposed forces. As wind loads on covers may tend to pull up against the weight of the cover, the latch must resist upward pull. The hinge latch may resist this force with several mechanisms. According to one embodiment of the invention, a spring-loaded pawl mechanism is used. Upward wind forces will act within a limited range of angles with respect to the latch components. The groove on the car component may be shaped to prevent release under these upward wind forces by the use of particularly selected internal contours. The effect is to prevent the latch system from releasing when pulled in a particular range of directions, while allowing the latch system to release with ease in other directions of pull such as are required for installation or removal.

Figure 5:
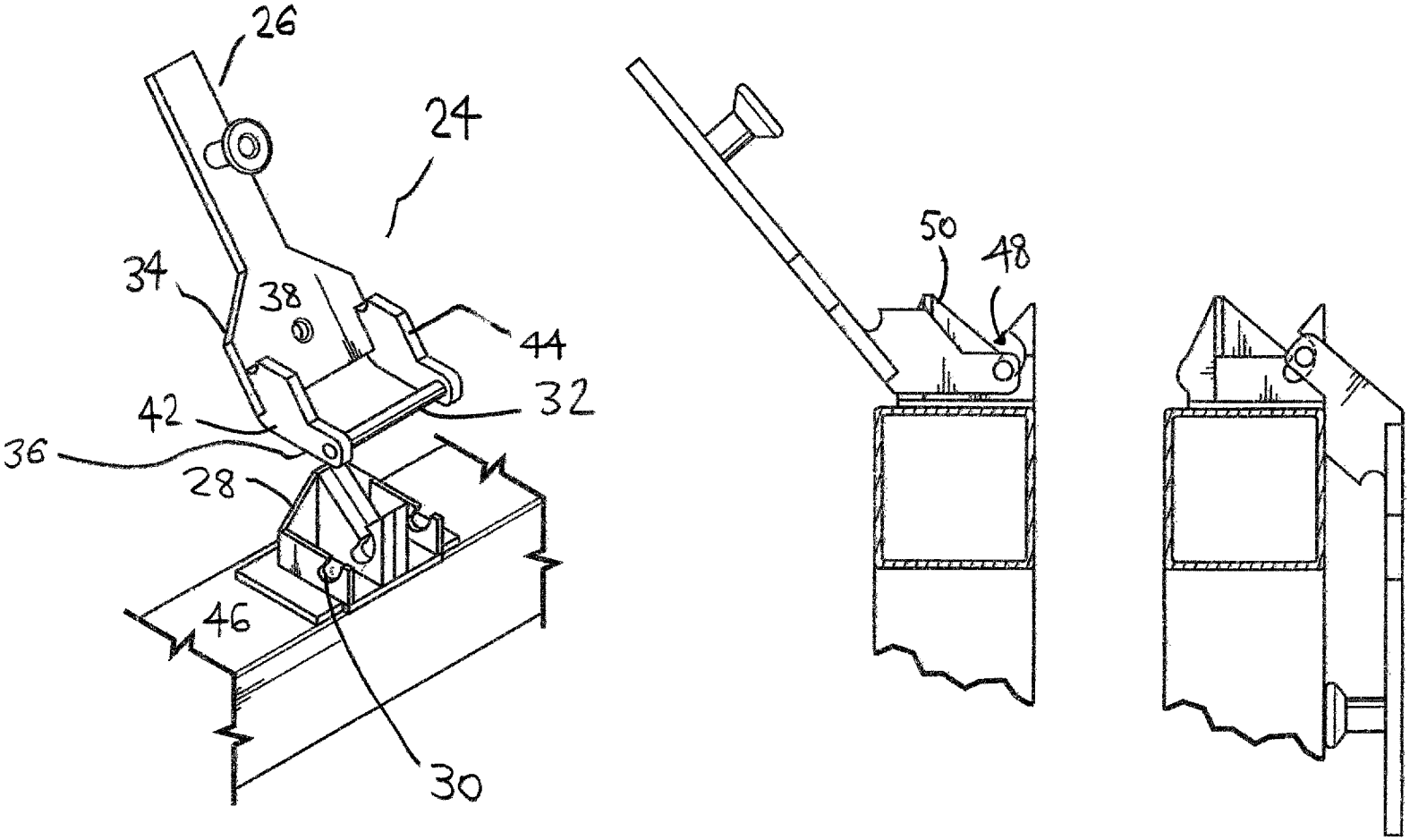
FIG. 5 is a perspective view, closed side plan view and open side plan view of the hinge-latch of the invention.
Figure 6:
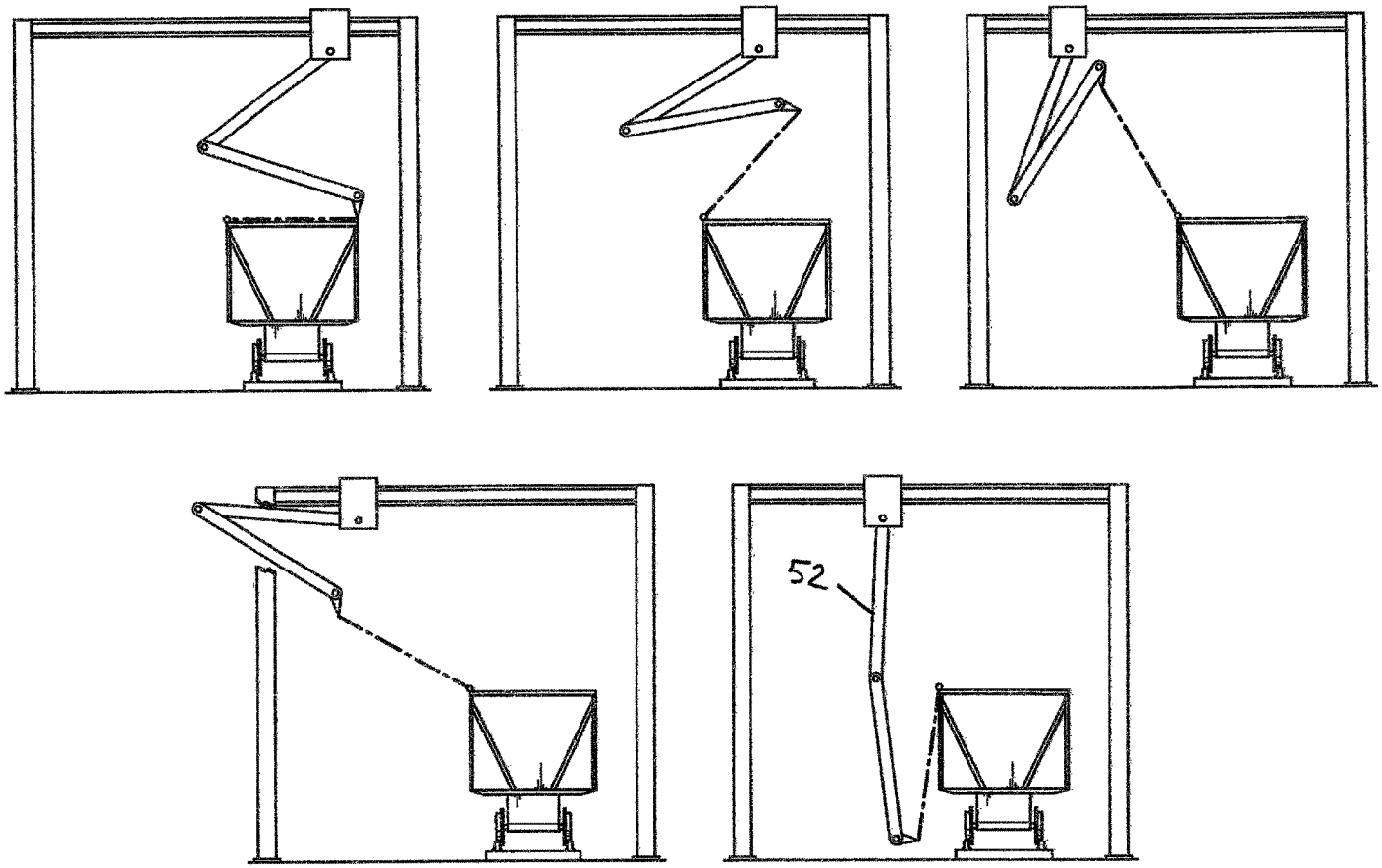
FIG. 6 is a series of end plan views of a covered railcar showing the sequence of removal of the railcar cover using a joint arm lifting system, according to another embodiment of the invention.
Figure 8:
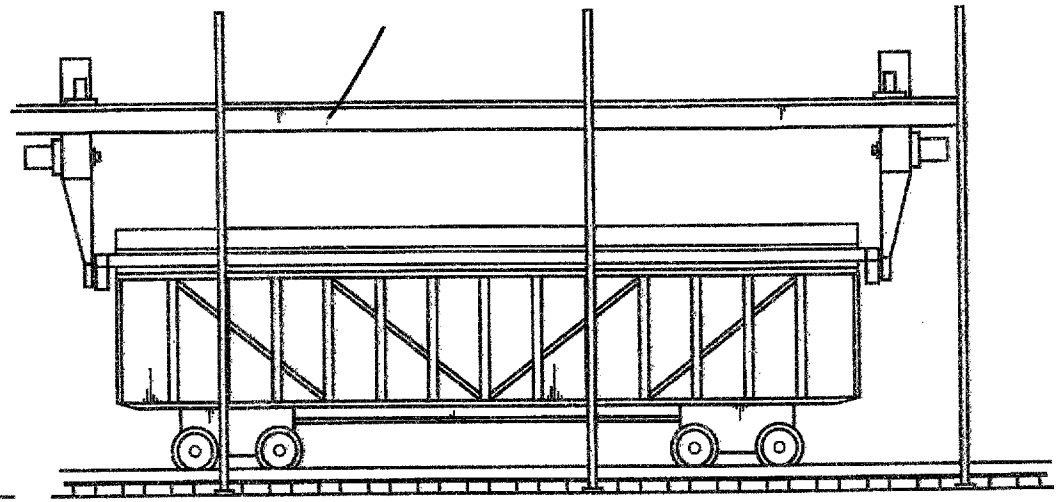
FIG. 8 is a side plan view of a railcar in a single joint arm lifting system.
Figure 7:
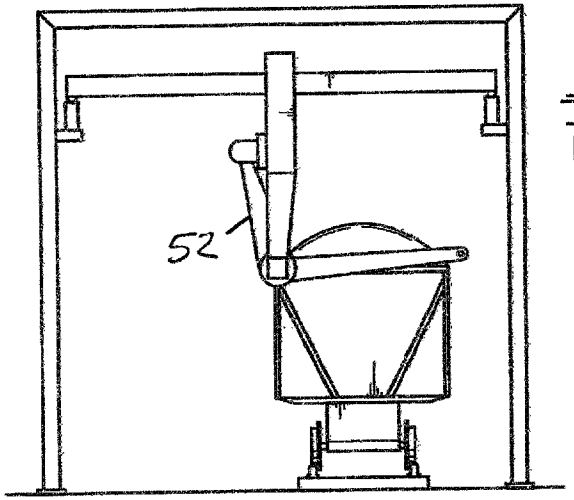
FIG. 7 is an end plan view of a railcar in a single joint arm lifting system.
Figure 9:
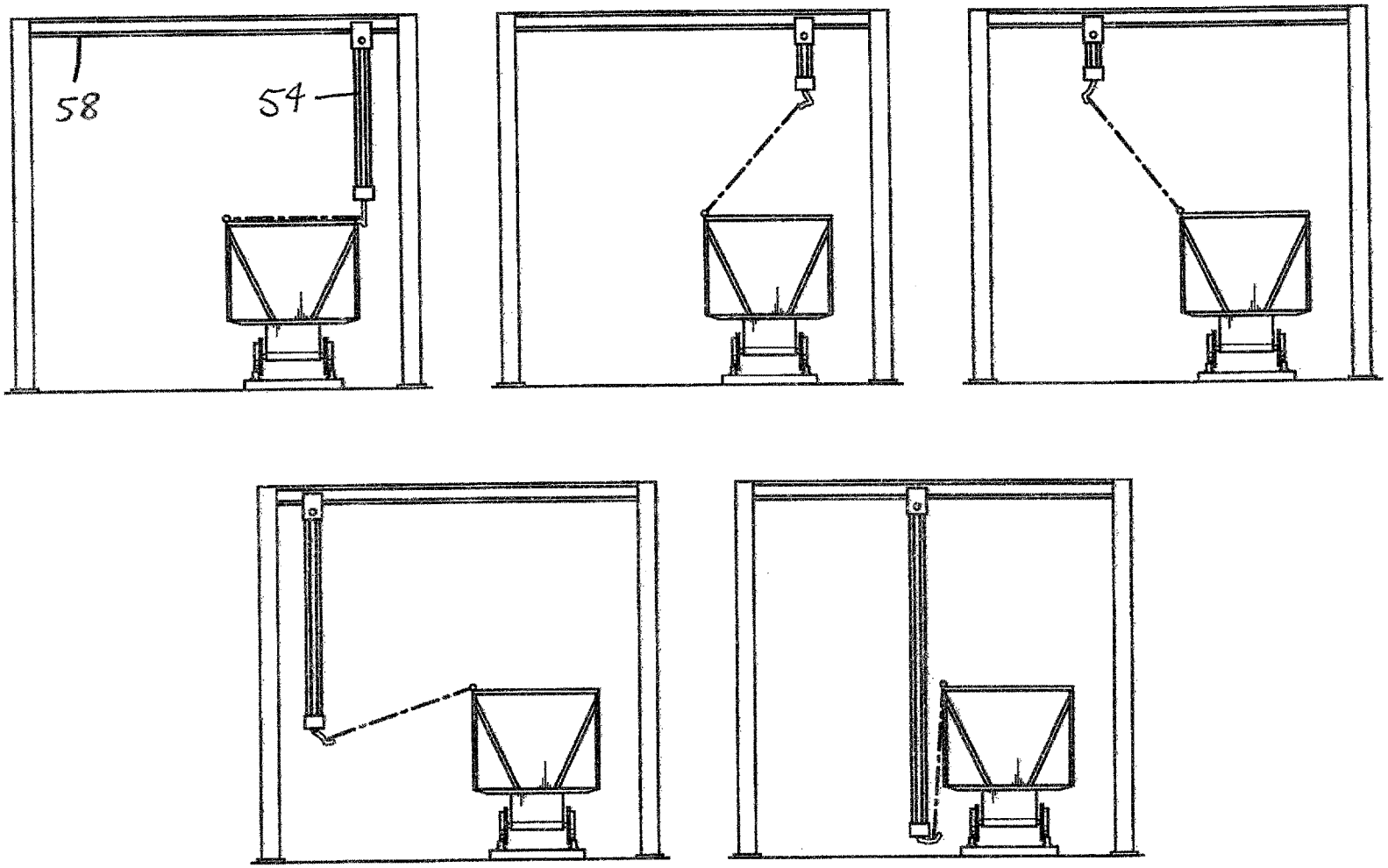
FIG. 9 is a series of end plan views of a covered railcar showing the sequence of removal of the railcar cover using a crane system, according to a further embodiment of the invention.

As depicted in FIG. 5, each hinge consists of two sub-assemblies, a cover sub-assembly 26 associated with the cover, and a car sub-assembly 28 associated with the top sill or gunnel of the railcar. The cover sub-assembly consists of a plate 38 attached to the external surface 40 of the cover. A pair of parallel brackets 42, 44 extend perpendicularly out from the plate, with a transverse hinge bar 32 extending between the parallel brackets, generally colinearly with the top sill 46 of the railcar. The car sub-assembly of each hinge consists of at least one hinge bar receptacle 48, each hinge bar receptacle having a selectively shaped receiving plate 50 to guide the hinge bar into a locking position as the cover closes. When closed, the hinge bar of the cover sub-assembly sits in a groove 30 cut into each hinge rod receptacle.

Each cover may be unlatched along one edge and rotated from a closed position to an open position from a moving string of rail cars in a continuous process.

There are several options for opening the covers. In operation, the cover is firmly locked to the top sill of the rail car when traveling between loading and unloading facilities. As the car approaches a loading or unloading site, it travels under or past an opening mechanism. As each car approaches and passes the opening mechanism, engaging means may engage hardware on the cover to enable the cover to be lifted and moved into an open position.

As shown in FIGS. 6, 7, 8, and 9, cover lifting means may comprise one or more single joint arms or multiple joint arms 52. The jointed-arms may position cover engaging means to engage hardware on the cover to enable it to be opened. Alternatively, cover lifting means may comprise a crane-like 54 apparatus to lift and manipulate the covers.

The cover lifting means may engage hardware on the cover to enable the cover to be opened. The cover lifting means may lift one longitudinal edge of the cover upwardly and rotate it into an open position flat against the side of the car. In this open position, the cover is clear of the loading and unloading processes. In one embodiment, the cover may travel with the rail car through the loading or unloading process. After loading or unloading, cover lifting means may engage hardware on the cover and rotate the cover into a closed position atop the rail car before releasing the cover hardware.

The cover lifting means may comprise a fixed guide which engages the cover or hardware on the cover, to enable it to be opened by the motion of the rail car relative to the position of the guide. As the rail car moves past the guide, the guide lifts the leading edge of the cover up and rotates the cover along the geometric path of the guide such that the cover is rotated into an open position alongside the rail car. The process may be used in reverse to return the cover from an open position to a closed position atop the rail car.

The shape of the guide causes the cover to rotate about its pivot axis, which may be a series of hinges on the side of the cover, until the entire top of the railcar is exposed. This partially open position is achieved with a cover rotation of at least 90 degrees. The cover may then be supported in this partially open position while material is loaded in the car, or it may be rotated further to a fully open position, at which position it will lay against the side of the railcar. If necessary to avoid structural components of the loading or unloading facility, the cover may be forcible compressed, by the use of an angled wall, pipe or similar deforming device along the cover's lower edge towards the car body, flattening the cover into a smaller volume.

As the car exits the loading or unloading area, a guide engages the cover and rotates the cover from an open position into a closed position. Once the cover is closed, the cover hardware may be disengaged, allowing the cars to travel to their next destination.

The support means for removing and transporting the rail car covers may be overhead means or ground-based means. In one embodiment of the present invention, the support means may comprise an overhead structural frame 56 for supporting the cover lifting means. The cover lifting means may comprise crane means attached to the support means for lowering a cover handling device to engage hardware on the cover. Once engaged, according to one embodiment, the cover may be picked up and moved away from the rail car.

According to another embodiment, a frame supports a mechanical system of jointed arms above or beside a string of rail cars having covers.

According to yet another embodiment of the present invention, a frame supports a curved track 58 above and around a string of rail cars with covers. The track supports a mechanical device that moves along a path described by the geometry of the track. The mechanical device carried on the track positions a handling device over the rail car to engage hardware on the cover to enable the cover to be opened into an open position alongside the rail car as described above.

In one embodiment, each cover remains attached to the rail car along one edge as the rail car travels through a loading or unloading process. Once through the loading or unloading process, the cover is rotated back into the closed position.

In an alternate embodiment, covers may be completely removed from the rail cars at an unloading site and transported by a conveying system to a loading site for replacement on the rail cars. A continuous belt or chain mechanical conveyor system may be used. The handling device lifts the cover away from the car and deposits the cover on a mechanical conveyance device such as a belt or chain conveyor that carries the cover away from the path of the cars. The mechanical conveyance device may direct the cover around a loading or unloading facility to a subsequent location for replacing covers on the cars.

Alternatively, rail car covers may be removed at a cover removal location and stockpiled on vehicles for transport to a cover replacement location.

In one embodiment, inclined tracks may guide a mechanical device carrying the rail car cover upwardly and away from the path of the rail cars. The tracks may convey the cover around a loading or unloading facility to a location for replacement of covers on the cars. In a preferred embodiment, the same cover removed from a selected car may be replaced on that car. Alternatively, it may be desirable to place another cover on the selected car. At the replacement location, the mechanical device may be guided along an inclined track toward the path of the line of rail cars to permit the mechanical device to replace the cover and release it on top of the rail car.

Covers may be removed from a moving train of rail cars on a continuous basis to be transported away from the rail car, around a loading or unloading process then returned to the string of rail cars and replaced on the cars.

In yet another embodiment of the present invention, the removed cover may be deposited by the cover lifting means on a transport cart or vehicle similar to a road trailer or purpose-built car running on a guideway which may carry a plurality of covers away from the path of the rail cars. The transport cart or similar vehicle may deliver a plurality of covers around a loading or unloading facility to a subsequent location for replacement of the covers on the cars.

In another aspect, the present invention may comprise a semi-automatic or fully automatic system for controlling the shape profile of the top of a bulk material load on a moving gondola rail car loaded at another location to assure functioning of the rail car cover system. A frame-supported mechanism may lower a load grooming device that can be run along the top of the load. The device may resemble a plow with a bottom edge contoured to the appropriate shape. The plow may be augmented by augers, paddle wheels, or other mechanical devices to redistribute the material into the best shape. The machine will detect and respond to the height of the car to provide a consistent profile shape of the load. The device may move in the same direction as the cars at a relatively high speed, or in a retrograde direction at a relatively slower speed. Alternatively, the device may remain fixed relative to the ground while allowing the train to move under it, thereby grooming the load profile.

Figure 10:
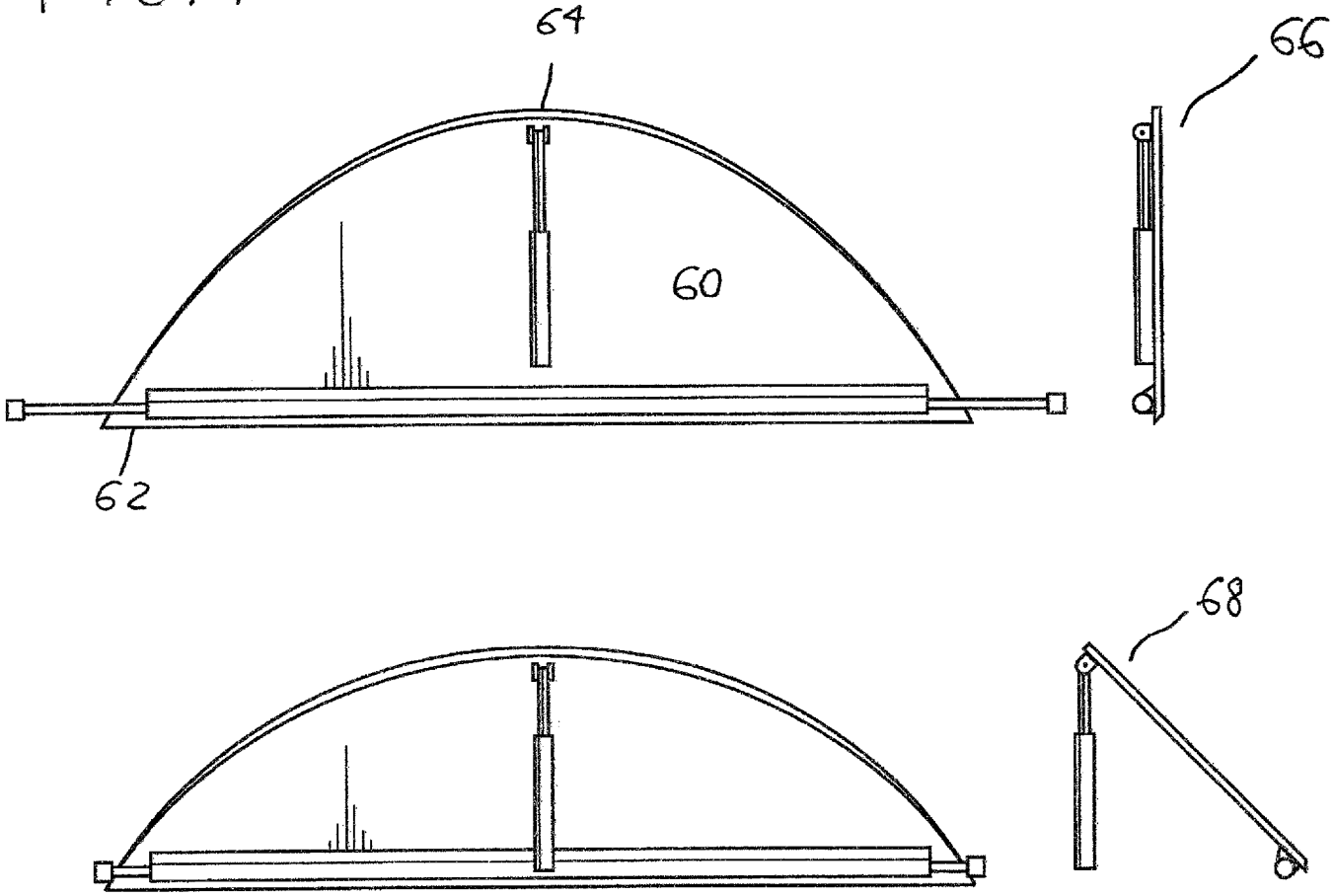
FIG. 10 depicts end plan and side plan views of an end closure door in an open position and in a closed position.

According to a further aspect of the present invention, as shown in FIG. 10, each cover system further comprises a pair of end closure doors. Each end closure door 60 is shaped to conform to the contour of the cover system and is pivotable along its lower straight edge 62 and its apex 64. The pivoting means on the lower edge may rotate on two axis and may adjust to conform to the change in shape of the cover as it opens. The pivoting means on the apex rotates on one axis and adjusts to conform to the change in shape of the cover as it opens. The end closure door rotates into a flat position 66 when the cover is in an open position. When the cover is in a closed position, the end closure door rotates into a raised position 68 to prevent entry of rain, snow or debris and loss of material during transport.

It will be appreciated by those skilled in the art that other variations of the preferred embodiment may also be practiced without departing from the scope of the invention.

The invention claimed is:

1. A cover assembly for a railcar of the type having a top opening and first and second sides, the cover assembly comprising:

a semi-rigid cover having opposed first and second side edges;

first and second linkage means, first linkage means connecting first side edge to first side, and second linkage means connecting second side edge to second side;

wherein cover is reversibly movable between a closed position atop the railcar and an open position alongside either the first or the second side of the railcar, and the linkage means comprise one or more pairs of arm linkages, each arm linkage pivotally connected at a first end to the cover and at a second end to the railcar and each arm linkage having a length greater than half a width of the cover extending between the first and second side edges.

2. The cover assembly of claim 1, further comprising a first end closure door at a first longitudinal end of the cover and a second end closure door at an opposing second longitudinal end of the cover, each end closure door pivotable about a lower straight edge and about an apex.

3. The cover assembly of claim 2, wherein each end closure door is convertible between a position co-planar to the cover when the cover is in an open position and a non-planar raised position when the cover is in a closed position.

4. A cover system for open top railcars comprising:

cover means for reversibly covering the open top of the railcar;

cover attachment means for reversibly attaching the cover means to an open top rail car;

cover lifting means for moving cover means from a closed position to an open position;

cover engagement means for releasably connecting cover lifting means to cover means;

support means for positioning and guiding the cover lifting means;

cover transport means for moving cover means from a railcar unloading location to a railcar loading location, wherein the cover attachment means comprises a plurality of arm linkages, each arm linkage having a length greater than half a width of the cover extending between the first and second side edges and pivotally connected at a first end to the cover and at a second end to the railcar.

5. The cover system of claim 4, wherein the cover means is a unitary cover convertible between a convex closed position atop the railcar and a flat open position.

6. The cover system of claim 4, wherein the cover means comprises a plurality of covers, each cover covering a portion of the opening of the railcar.

7. The cover system of claim 4, further comprising receiving means, wherein the cover lifting means comprises a stationary opening mechanism at a railcar loading facility, the opening mechanism having engaging means for engaging the receiving means of the cover system and lifting the cover as the railcar moves past the opening mechanism.

8. The cover system of claim 7, wherein the cover lifting means further comprises a fixed helical guide which engages the cover and lifts the cover as the railcar moves past the guide.

9. The cover system of claim 4, further comprising receiving means, wherein the cover lifting means comprises one or more arms for engaging the receiving means of the cover system and lifting the cover.

10. The cover system of claim 9, wherein each arm is a multiple-joint arm.

11. The cover system of claim 4, the cover system further comprising receiving means, wherein the cover lifting means comprises a crane apparatus for engaging the receiving means of the cover system and lifting the cover.

12. The cover system of claim 4, wherein the support means comprises an overhead structural frame.

13. The cover system of claim 4, wherein the support means comprises a ground based curved track above and around a string of railcars.

* * * * *